United States Patent [19]

Wright

[11] 3,981,537

[45] Sept. 21, 1976

[54] PERSON'S BODY WEIGHT SUPPORT IN FURNITURE ASSEMBLY

[75] Inventor: John T. Wright, Cattaraugus, N.Y.

[73] Assignee: Champion International Corporation, Stamford, Conn.

[22] Filed: May 21, 1975

[21] Appl. No.: 579,447

[52] U.S. Cl. ..... 297/452; 5/186 R; 267/83

[51] Int. Cl.[2] ..... A47C 7/02

[58] Field of Search ..... 297/452; 248/392, 391; 5/186, 189; 52/615; 428/457–465; 267/83

[56] References Cited

UNITED STATES PATENTS

| | | | |
|---|---|---|---|
| 240,641 | 4/1881 | Bartels | 428/459 |
| 1,810,281 | 6/1931 | Linse | 428/459 X |
| 1,912,711 | 6/1933 | Kindel | 5/186 B |
| 2,004,549 | 6/1935 | Boyd | 5/186 B |
| 2,011,130 | 8/1935 | Ward | 428/459 |
| 2,125,773 | 8/1938 | Drabenstoff | 297/452 X |
| 2,393,349 | 1/1946 | Weingarten | 5/189 |
| 2,601,284 | 6/1952 | Hemming | 428/460 |
| 2,722,267 | 11/1955 | Liljengren | 297/452 |
| 3,094,357 | 6/1963 | Shwayder | 297/452 |
| 3,720,568 | 3/1973 | Rowland | 297/452 |

*Primary Examiner*—James C. Mitchell
*Attorney, Agent, or Firm*—Evelyn M. Sommer

[57] ABSTRACT

Support assembly in a piece of furniture for bearing some weight of a person's body. Assembly includes a relatively rigid frame having at least a pair of laterally-spaced panel supports. A weight bearing panel has laterally-spaced edge zones for anchoring to the pair of laterally-spaced frame supports. The panel may comprise an outer layer against which body weight is to be applied and comprises cellulosic fibers. A rearward tensile layer of this panel is of compact material having a moderately high modulus of tension, and a layer of set glue intervenes to fasten together these outer and rearward layers. Suitable anchoring means fasten the laterally-spaced panel edge zones to the pair of laterally-spaced frame supports. The rearward tensile panel layer may comprise economical dead steel, aluminum or like metallic sheeting as contrasted with spring steel sheeting. The outer layer of cellulosic fibers may comprise hardboard, particle-board, plywood or the like. The panel desirably may be convexed on the outer layer side substantially medially of the anchoring edge zones as the latter are fixed to the laterally-spaced frame panel supports, with this convexed panel being deflectable reversely under applied body load to concave contour for sling support of this load.

4 Claims, 6 Drawing Figures

PERSON'S BODY WEIGHT SUPPORT IN FURNITURE ASSEMBLY

SUMMARY

The present invention relates to body load supporting structures in furniture, such as seat and back rest frame assemblies, which assure elastic response to provide comfort.

Prior to the present invention it has been proposed to embody and mount in seat and back rest constructions of funiture a variety of types of spring constructions in groups of individual units which require tedious and excessive time-consuming successive anchorage for cooperative action to effect the desired body weight support. Such individual construction units also are relatively costly.

It is a general object of the present invention to avoid such undesirable characteristics while improving the actions of the load bearing structure in an unusually simple and economical manner.

Another object of the invention is to provide such economically constructed assemblies in forms to include a panel having laterally-spaced anchoring edge zones and a relatively rigid frame having a pair of laterally-spaced panel supports to each of which one of the panel edge zones is anchored in a very simple and quickly installed manner.

A further object of the invention is to provide such load-bearing panel in a plural layer form with at least two layers thereof comprising, respectively, an outer layer against which body weight is to be applied and formed chiefly of cellulosic fibers, and a rearward tensile layer of compact material having a moderately high modulus of tension; such plural layer construction including set glue intervening these layers, with or without additional intervening layers, such glue fastening those layers together in a multiply assembly.

An additional object of the invention is to provide the outer cellulosic fibers layer in the form of hardboard, particle-board, plywood or the like to assure the desired economy while satisfying the simple structural needs.

A still further object of the invention is to provide the rearward tensile layer in an economical form comprising dead steel, aluminium or the like metallic sheeting, instead of employing costly spring steel which is made unnecessary by virtue of the characteristics of the present multiply assembly.

Other objects of the invention will in part be obvious and will in part appear from reference to the following detailed description taken in connection with the accompanying drawing, wherein like numerals identify similar parts throughout, and in which.

Figure 3:
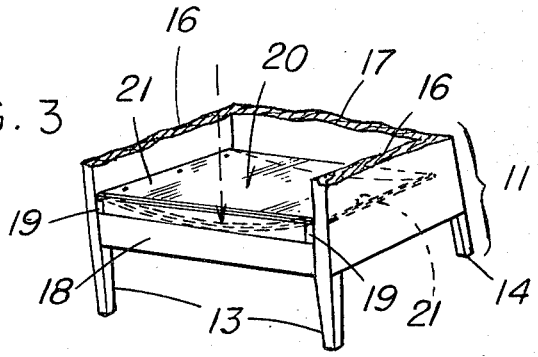
FIG. 3 is a perspective view of a lower portion of the chair structure illustrated in FIGS. 1 and 2, with the upholstery and cushioning means omitted and parts broken away in order to show more clearly the assembly of the present invention which includes a relatively rigid frame and the plural layer panel mounted thereto.
Figure 5:
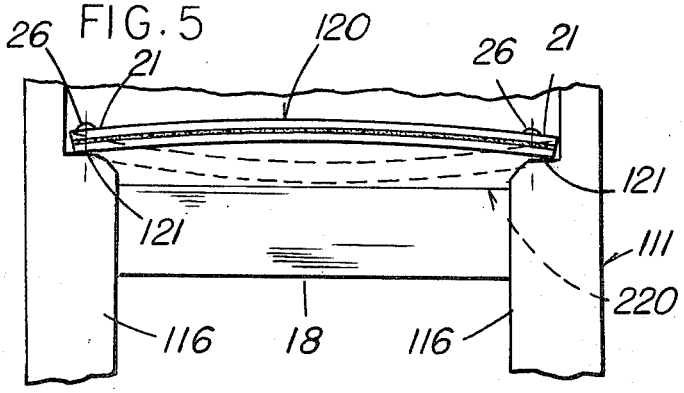
Figure 6:
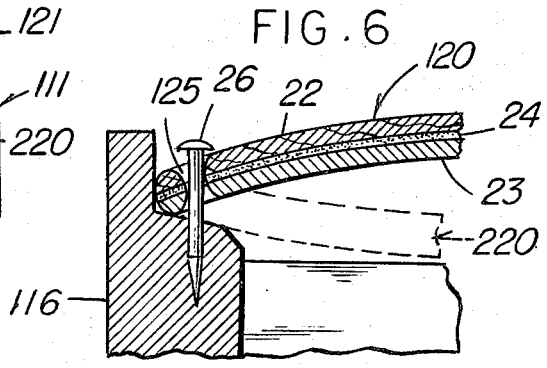

FIG. 5 is a front elevational view of a portion of the lower frame assembly of a chair, with parts broken away, which may be of a form similar to that illustrated in FIG. 3, but showing another embodiment of the panel which has been convexly flexed in the anchorage thereof to the supporting rigid frame assembly; and FIG. 6 is a detailed sectional view, with parts broken away, of a portion of the rigid supporting frame and an anchoring edge zone of the panel with suitable anchoring means illustrated in simple form.

Figure 1:
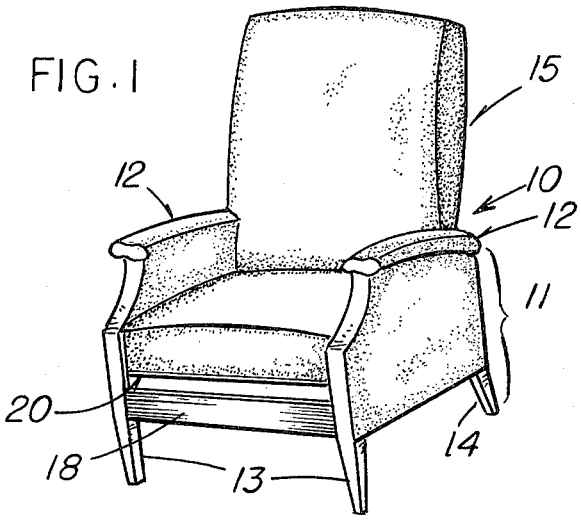
FIG. 1 is a perspective view of an armchair of simplified construction in which the seat includes a frame assembly of the present invention overlaid by a seat cushion.
Figure 2:
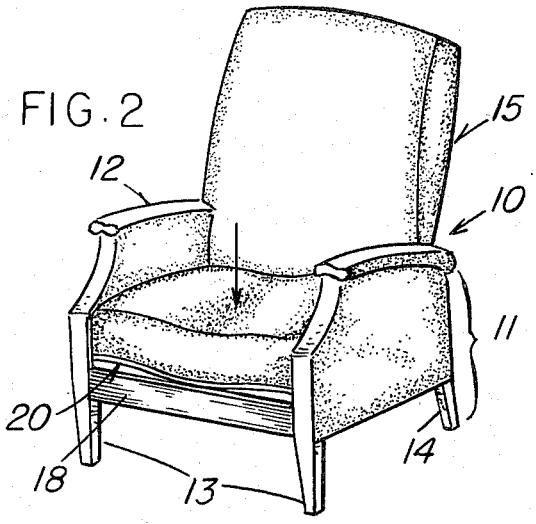
FIG. 2 is a perspective view similar to FIG. 1 of the construction therein illustrated and a typical depression of the seat cushion and supporting frame structure due to the application thereto of some of a person's body load.

As is illustrated in FIGS. 1 and 2 a rather simple upholstered armchair 10 may include a lower frame structure 11 which is provided with upholstered side arms 12 and the necessary legs 13 and 14. This lower frame assembly 11 and the side arms 12 together provide support for the upholstered back 15.

As will be best understood from FIG. 3, which shows the major portion of the frame structure of the lower chair section 11 with the upholstery omitted, this includes a relatively rigid frame of a chair of laterally-spaced side boards 16 bridged by a backboard 17 and a front strip 18 all securely fastened together for rigidity. The side boards 16 support on their opposed inner faces strips 19 with the top thereof forming support ledges to serve as laterally-spaced panel supports.

Figure 4:
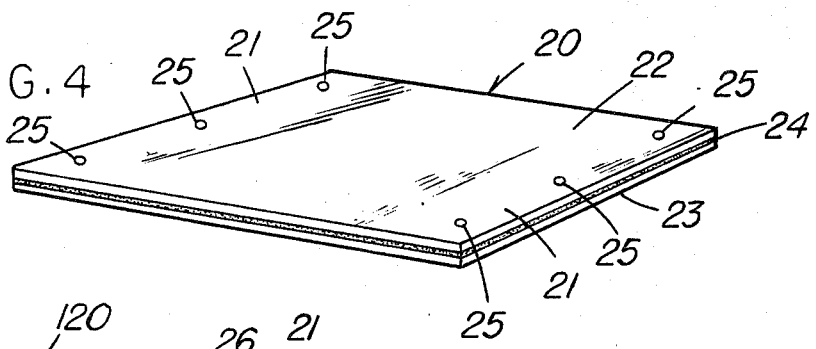
FIG. 4 is an enlarged perspective view of a panel of the present invention which includes an outer or top layer against which body weight is to be applied and a rearward tensile layer of compact material with opposed faces of these layers fastened together by intervening set glue and with this layer illustrated in exaggerated relative thickness for understanding.

This lower frame assembly also includes a weight-bearing panel 20 having a pair of laterally-spaced anchoring edge zones 21. These panel edge zones 21 are fastened by any suitable anchoring means, such as screws or pins, to the pair of laterally-spaced frame supports 19. As will be better understood from FIG. 4 this weight-bearing panel 20 may consist in its simplest form of an outer or top layer 22 comprising or consisting chiefly of cellulosic fibers, and a rearward or bottom tensile layer 23 of compact material having a moderately high modulus of tension. The bottom face of the top layer 22 and the opposed top face of the bottom tensile layer 23 are fastened together by an intervening layer 24 of set glue, which may be of conventional synthetic resin. It will be noted from FIG. 4 that the chair of laterally-spaced anchoring edge zones 21 of the panel 20 are, by way of example, provided with a plurality of screw or pin holes 25 to serve in cooperation with such anchoring elements means for fastening these panel edge zones to the pair of laterally-spaced frame supports 19. In doing so, in the manner illustrated in FIG. 3, desirable greater rigidity is provided to the chair lower frame construction or assembly 11.

It is illustrated in full lines in FIG. 2 and in dotted lines in FIG. 3 that when weight of a portion of a person's body is applied to the seat assembly this weight-bearing panel is substantially medially bowed downward to support the sitter with comfort.

The embodiment of FIGS. 5 and 6 includes substantially equivalent elements of the lower section, here referenced 111, of the chair illustrated in FIGS. 1–3 incl., with a minor variation of the laterally-spaced panel supports in the form of rabbeted ledges 121 of the frame side board structures 116. It wll be noted from FIGS. 5 and 6 that apertures spaced along the pair of laterally-spaced anchoring edge zones 21 of the seat panel 120 may be fastened or anchored to the laterally-spaced supporting ledges 121 by pins 26. In so anchoring these panel edge zones the panel may desirably be stressed to the convex shape shown so that this convex panel may be deflectable reversely under applied body load, as is suggested in dotted lines at 220, to a concave contour for comfortable sling support of this load.

Economy in construction of such a load-bearing panel is attained while providing the necessary load-bearing characteristics by forming the outer layer of the panel of a material comprising chiefly cellulosic fibers, e.g., hard-board, particle-board, plywood or the like. Wood slabs are undesirable for this purpose because of the high cost thereof and the undependability of the structural characteristics. The rearward tensile layer of compact material has a desirably moderately high modulus of tension, but the high modulus of torque of spring steel is deliberately avoided not only to avoid the high cost of the latter, but also as being undesirable for the present purposes. Thus this rearward or bottom layer will comprise dead steel, aluminum or like metallic sheeting to assure the desirable moderately high modulus of tension.

It will thus be seen that the objects set forth above, among those made apparent from the preceding description, are efficiently attained and, since certain changes may be made in the above article without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim as new and desire to secure by Letters Patent is the novel subjects matter defined in the following claims.

1. A seat support assembly in a piece of furniture for bearing some weight of a person's body comprising:

1. a relatively rigid peripheral frame having at least a pair of laterally-spaced panel supports;

2. a weight-bearing panel having laterally-spaced, anchoring edge zones with said panel including an upper layer against which body weight is to be applied and comprising cellulosic fibers, a lower tensile layer of metallic material having a moderately high modulus of tension, and a layer of set glue intervening said layers and fastening the latter together; and

3. anchoring support means fastening said panel edge zones to said pair of laterally-spaced frame supports in a manner whereby said weight-bearing panel is convexed upwardly above the median plane extending between said panel supports when no body load is applied to the panel, whereas under an applied body load, said panel is deflected reversibly to a concave contour for sling support of the body load.

2. The body support assembly of claim 1 characterized by said cellulosic fibers layer comprising hard-board, particle-board, plywood or the like.

3. The body support assembly of claim 1 characterized by said tensile layer comprising dead steel, aluminum or the like metallic sheeting.

4. The body support assembly of claim 1 characterized by said cellulosic fibers layer comprising hard-board, particle-board, plywood or the like, and said tensile layer comprising dead steel, aluminum or the like metallic sheeting.

* * * * *